US009642412B2

(12) United States Patent
Klotz et al.

(10) Patent No.: US 9,642,412 B2
(45) Date of Patent: May 9, 2017

(54) ADJUSTMENT MECHANISM FOR A HEADBAND ARRANGEMENT OF A SAFETY HELMET

(71) Applicant: MSA Technology, LLC, Cranberry, PA (US)

(72) Inventors: Robert Klotz, Jefferson Hills, PA (US); Kevin R. Ketterer, Portersville, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 179 days.

(21) Appl. No.: 14/461,724

(22) Filed: Aug. 18, 2014

(65) Prior Publication Data

US 2015/0059064 A1 Mar. 5, 2015

Related U.S. Application Data

(63) Continuation-in-part of application No. 14/138,860, filed on Dec. 23, 2013.

(60) Provisional application No. 61/872,090, filed on Aug. 30, 2013.

(51) Int. Cl.

| | |
|---|---|
| ***A42B 1/22*** | (2006.01) |
| ***A42B 3/32*** | (2006.01) |
| ***A42B 3/08*** | (2006.01) |
| ***A42B 3/14*** | (2006.01) |

(52) U.S. Cl.

CPC ..... *A42B 3/324* (2013.01); *A42B 3/085* (2013.01); *A42B 3/145* (2013.01)

(58) Field of Classification Search

CPC ..... A42B 3/085; A42B 3/145; A42B 3/324

See application file for complete search history.

(56) References Cited

U.S. PATENT DOCUMENTS

| | | | | |
|---|---|---|---|---|
| 7,174,575 | B1 | 2/2007 | Scherer | |
| 8,434,200 | B2 | 5/2013 | Chen | |
| 2007/0266481 | A1 | 11/2007 | Alexander et al. | |
| 2009/0211385 | A1 | 8/2009 | Fiquepron et al. | |
| 2009/0222978 | A1 | 9/2009 | Fang | |
| 2010/0095438 | A1 | 4/2010 | Moelker | |
| 2010/0281604 | A1 | 11/2010 | Grim et al. | |
| 2011/0088148 | A1 | 4/2011 | Chen | |
| 2011/0191946 | A1 | 8/2011 | Fang | |
| 2012/0296245 | A1* | 11/2012 | Ma | A42B 3/145 601/84 |

FOREIGN PATENT DOCUMENTS

| | | | |
|---|---|---|---|
| EP | 2359707 | A1 | 8/2011 |

* cited by examiner

*Primary Examiner* — Anna Kinsaul

(74) *Attorney, Agent, or Firm* — The Webb Law Firm

(57) ABSTRACT

An adjustment mechanism for a headband arrangement including a rotatable knob having a first contact member; a rotatable hub member to engage a notched track of a headband member; and a rotatable notched track member, wherein during contact between the first contact member and the hub member the rotatable notched track member does not rotate, and wherein during contact between a second contact member and the hub member the rotatable notched track member rotates in a second direction.

17 Claims, 16 Drawing Sheets

ADJUSTMENT MECHANISM FOR A HEADBAND ARRANGEMENT OF A SAFETY HELMET

CROSS REFERENCE TO RELATED APPLICATIONS

This application is a continuation-in-part of U.S. patent application Ser. No. 14/138,860, filed Dec. 23, 2013, which claims benefit of priority from U.S. Provisional Patent Application No. 61/872,090, filed Aug. 30, 2013, which are incorporated herein by reference in their entirety.

BACKGROUND OF THE INVENTION

Field of the Invention

The present invention relates generally to safety helmets for use in a variety of applications where head protection is desired, and in particular to an adjustment mechanism for a headband arrangement used in connection with such a safety helmet.

Description of the Related Art

As is known in the art, a variety of activities, workplace functions, and emergency situations require additional safety measures and systems. In particular, such activities, functions, and situations include, without limitation, industrial or manufacturing activities, construction activities, activities that pose a potential risk to the person or persons involved, rescue situations, and the like. Providing safety equipment to those involved in such activities and situations is required, and protecting the user's head is of the utmost importance. In order to provide such protection, the most often piece of equipment worn by the user is a safety helmet.

Safety helmets are provided in a variety of shapes and configurations. Further, in order to comfortably position and space the protective helmet body (or dome) of the safety helmet with respect to the user's head, each safety helmet is equipped with a suspension system. This suspension system normally includes: (1) a headband arrangement having a headband member that fits around the periphery of the user's head (normally just above the forehead area) and an adjustment mechanism for tightening and loosening the headband member with respect to a user's head; (2) multiple tabs, connected or connectable to the headband member, which are removably attachable in headband slots positioned on the inner surface of helmet body; and (3) multiple straps connected between the tabs and extending across the headband member for contact with the top of the user's head.

In order to adjust the tightness of the headband member about the user's head, the adjustment mechanism interacts with two extension portions of the headband member, where both of these extension portions include a track. These extension portions, and specifically the tracks thereof, are overlapped and positioned at least partially within the adjustment mechanism, which includes a gear-type member that simultaneously interacts with both tracks. By moving or causing the gear-type member to move in a first direction, and through interaction with the tracks, the headband member of the headband arrangement is tightened. Similarly, by moving or causing the gear-type member to move in a second direction, the headband member is loosened. In this manner, the headband member can be tightened or loosened by the user to allow effective and comfortable donning and removal of the safety helmet, as well as a comfortable fit while wearing the safety helmet in the working environment.

There are various drawbacks and deficiencies with existing adjustment mechanisms. First, many such existing mechanisms evidence "slop" or "play" in the adjustment process, which does not provide the user with instantaneous tactile feedback during this process. Second, in most cases, these existing adjustment mechanisms are not effective in preventing inadvertent loosening of the headband member, whether during the adjustment process or while the user is involved in their task. Third, existing adjustment mechanisms lack the ability to be continuously or fluidly (i.e., non-incrementally) adjustable. Fourth, many adjustment mechanisms are assembled in a permanent fashion, such as through the use of a metal pin or rivet, which prevents effective maintenance and represents potential risks in certain working environments.

Accordingly, there is a need in the art for improved safety helmets, suspension systems, and adjustment mechanisms for use with or in such suspension systems

SUMMARY OF THE INVENTION

Generally, provided is an adjustment mechanism for a headband arrangement of a safety helmet that provides improved features and functions with respect to known safety helmet systems and adjustment mechanism configurations. Preferably, provided is an adjustment mechanism for a headband arrangement of a safety helmet that reduces or eliminates "slop" in the adjustment process. Preferably, provided is an adjustment mechanism for a headband arrangement of a safety helmet that prevents inadvertent loosening of a headband member while the helmet is worn. Preferably, provided is an adjustment mechanism for a headband arrangement of a safety helmet that provides for constant adjustability of the headband member with respect to the user's head. Preferably, provided is an adjustment mechanism for a headband arrangement of a safety helmet that is easily assembled and disassembled.

In one preferred and non-limiting embodiment, provided is an adjustment mechanism for a headband arrangement having a headband member with at least one notched track positioned on an end thereof. The adjustment mechanism includes a rotatable knob having at least one first contact member and at least one second contact member and a rotatable hub member having a gear portion with teeth configured to engage the at least one notched track of the headband member, such that rotation of the hub member in a first direction causes the headband member to tighten and rotation of the hub member in a second direction causes the headband member to loosen. Upon rotation of the knob in the first direction, contact between the at least one first contact member and at least a portion of the hub member causes the hub member to rotate in the first direction, and upon rotation of the knob in the second direction, contact between the at least one second contact member and at least a portion of the hub member causes the hub member to rotate in the second direction.

In a further preferred and non-limiting embodiment, provided is a suspension system for a safety helmet, including: a headband arrangement having a headband member with at least one notched track positioned on an end thereof; at least one strap connected to at least one tab, wherein the at least one tab is configured to be inserted at least partially into at least one headband slot positioned on an internal surface of the safety helmet; and an adjustment mechanism. The adjustment mechanism includes: (i) a rotatable knob having at least one first contact member and at least one second contact member; and (ii) a rotatable hub member having a gear portion with teeth configured to engage the at least one notched track of the headband member, such that rotation of the hub member in a first direction causes the headband member to tighten and rotation of the hub member in a second direction causes the headband member to loosen. Upon rotation of the knob in the first direction, contact between the at least one first contact member and at least a portion of the hub member causes the hub member to rotate in the first direction, and upon rotation of the knob in the second direction, contact between the at least one second contact member and at least a portion of the hub member causes the hub member to rotate in the second direction.

In another preferred and non-limiting embodiment, provided is a safety helmet, including: a protective helmet body having an internal surface with at least one headband slot positioned thereon; suspension system for a safety helmet including: a headband arrangement having a headband member with at least one notched track positioned on an end thereof; at least one strap connected to at least one tab, wherein the at least one tab is configured to be inserted at least partially into the at least one headband slot to thereby connect the suspension system and the helmet body; and an adjustment mechanism. The adjustment mechanism includes: (i) a rotatable knob having at least one first contact member and at least one second contact member; and (ii) a rotatable hub member having a gear portion with teeth configured to engage the at least one notched track of the headband member, such that rotation of the hub member in a first direction causes the headband member to tighten and rotation of the hub member in a second direction causes the headband member to loosen. Upon rotation of the knob in the first direction, contact between the at least one first contact member and at least a portion of the hub member causes the hub member to rotate in the first direction, and upon rotation of the knob in the second direction, contact between the at least one second contact member and at least a portion of the hub member causes the hub member to rotate in the second direction.

In another preferred and non-limiting embodiment, provided is an adjustment mechanism for a headband arrangement having a headband member with at least one headband notched track positioned on an end thereof. The adjustment mechanism includes: a rotatable knob having at least one first contact member; a rotatable hub member having a gear portion with teeth configured to engage the at least one headband notched track of the headband member, such that rotation of the hub member in a first direction causes the headband member to tighten and rotation of the hub member in a second direction causes the headband member to loosen; and a rotatable notched track member comprising a plurality of teeth. Upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between at least one second contact member and at least a portion of the hub member causes the hub member to rotate in the second direction with at least a portion of the at least one second contact member interacting with the rotatable notched track member, such that the rotatable notched track member rotates in the second direction.

In a further preferred and non-limiting embodiment, provided is a suspension system for a safety helmet, including: a headband arrangement having a headband member with at least one notched track positioned on an end thereof; at least one strap connected to at least one tab, wherein the at least one tab is configured to be inserted at least partially into at least one headband slot positioned on an internal surface of the safety helmet; and an adjustment mechanism. The adjustment mechanism includes: (i) a rotatable knob having at least one first contact member; (ii) a rotatable hub member having a gear portion with teeth configured to engage the at least one headband notched track of the headband member, such that rotation of the hub member in a first direction causes the headband member to tighten and rotation of the hub member in a second direction causes the headband member to loosen; and (iii) a rotatable notched track member comprising a plurality of teeth. Upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between at least one second contact member and at least a portion of the hub member causes the hub member to rotate in the second direction with at least a portion of the at least one second contact member interacting with the rotatable notched track member, such that the rotatable notched track member rotates in the second direction.

In a still further preferred and non-limiting embodiment, provided is a safety helmet, including: a protective helmet body having an internal surface with at least one headband slot positioned thereon; suspension system for a safety helmet having: a headband arrangement having a headband member with at least one notched track positioned on an end thereof; at least one strap connected to at least one tab, wherein the at least one tab is configured to be inserted at least partially into the at least one headband slot to thereby connect the suspension system and the helmet body; and an adjustment mechanism. The adjustment mechanism includes: (i) a rotatable knob having at least one first contact member; (ii) a rotatable hub member having a gear portion with teeth configured to engage the at least one headband notched track of the headband member, such that rotation of the hub member in a first direction causes the headband member to tighten and rotation of the hub member in a second direction causes the headband member to loosen; and (iii) a rotatable notched track member comprising a plurality of teeth. Upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between at least one second contact member and at least a portion of the hub member causes the hub member to rotate in the second direction with at least a portion of the at least one second contact member interacting with the rotatable notched track member, such that the rotatable notched track member rotates in the second direction.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
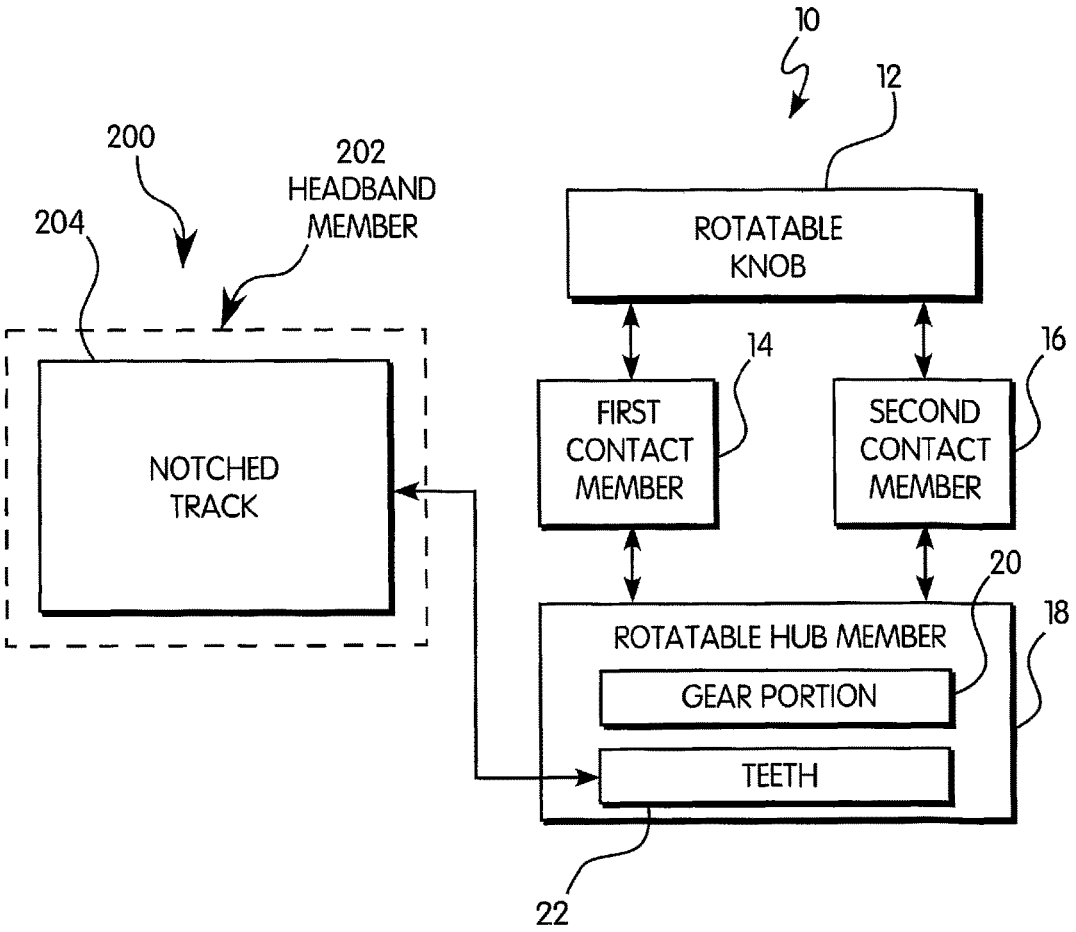
FIG. 1 is a schematic view of an adjustment mechanism for a suspension system of a safety helmet according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to an adjustment mechanism 10 that is used in connection with or as part of a headband arrangement 200. One preferred and non-limiting embodiment of the adjustment mechanism 10 is illustrated in FIG. 1 in schematic form, and further preferred and non-limiting embodiments of the adjustment mechanism and its various components are shown in FIGS. 2-10. With reference to FIG. 1, the adjustment mechanism 10 according to the present invention is used in connection with or in a headband arrangement 200, which includes a headband member 202 with at least one notched track 204 positioned on, typically, an end of the headband member 202. Further, this headband arrangement 200 is normally part of or used in connection with a suspension system for a safety helmet. In particular, and in order to allow the safety helmet to be used by a variety of people having differently shaped and sized heads, the headband member 202 must be adjustable. As discussed above, and in order to facilitate such adjustment, most headband arrangements 200 include some form of an adjustment mechanism. However, and as discussed more fully hereinafter, the adjustment mechanism 10 according to the present invention provides certain unique advantages and benefits as compared to the existing adjustment mechanisms and headband arrangements.

With continued reference to FIG. 1, and in one preferred and non-limiting embodiment, the adjustment mechanism 10 includes a rotatable knob 12 that includes or is integral with at least one first contact member 14 and at least one second contact member 16. Further, in this embodiment, the adjustment mechanism 10 includes a rotatable hub member 18 having a gear portion 20 with teeth 22 that are sized, shaped, or configured to engage the notched track 204 of the headband member 202. This engagement between the hub member 18 and the notched track 204 of the headband member 202 is such that rotation of the hub member 18 in a first direction causes the headband member 202 to tighten, and rotation of the hub member 18 in a second direction causes the headband member 202 to loosen.

Figure 2:
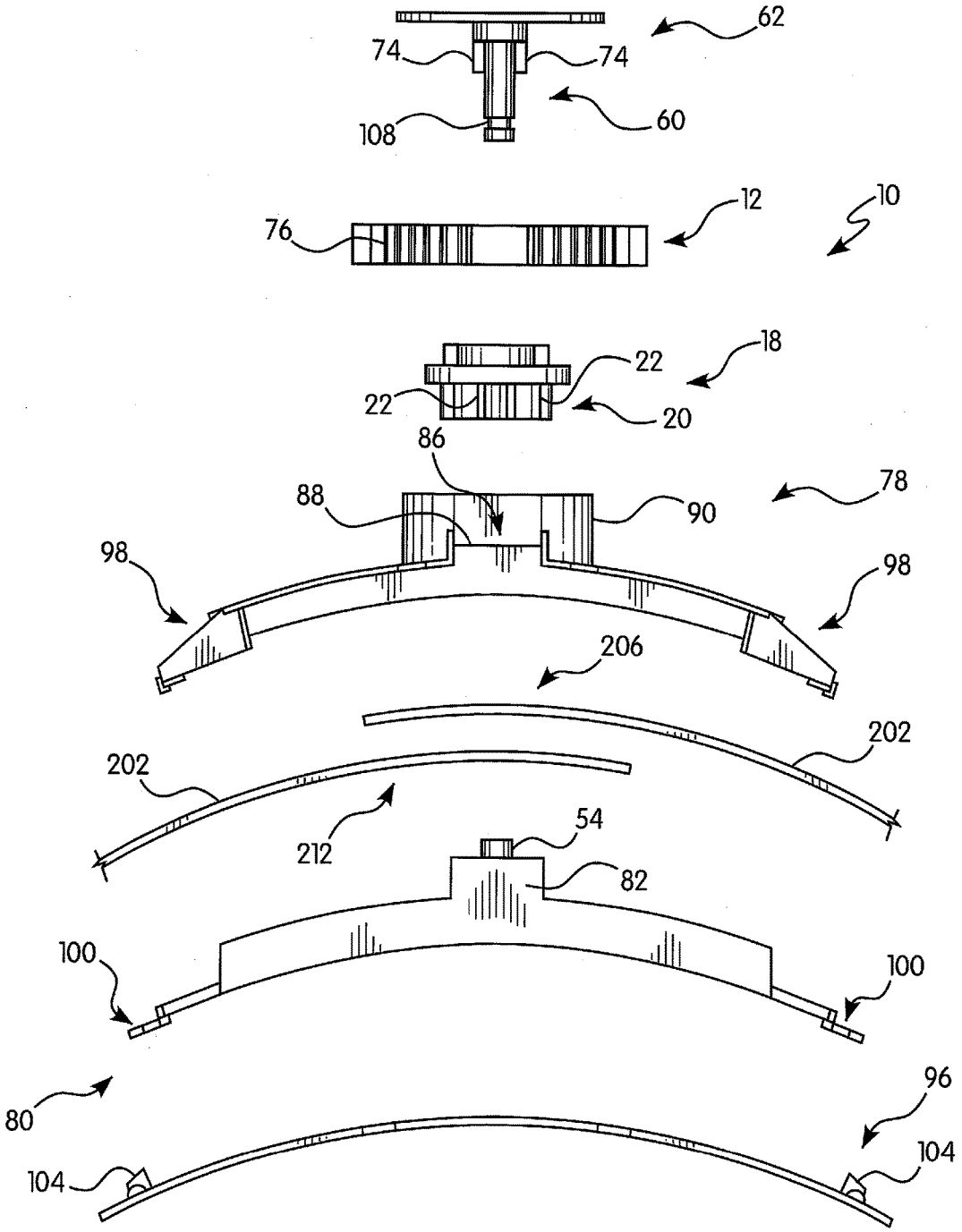
FIG. 2 is an exploded side view of one embodiment of an adjustment mechanism for a suspension system of a safety helmet according to the principles of the present invention.
Figure 5:
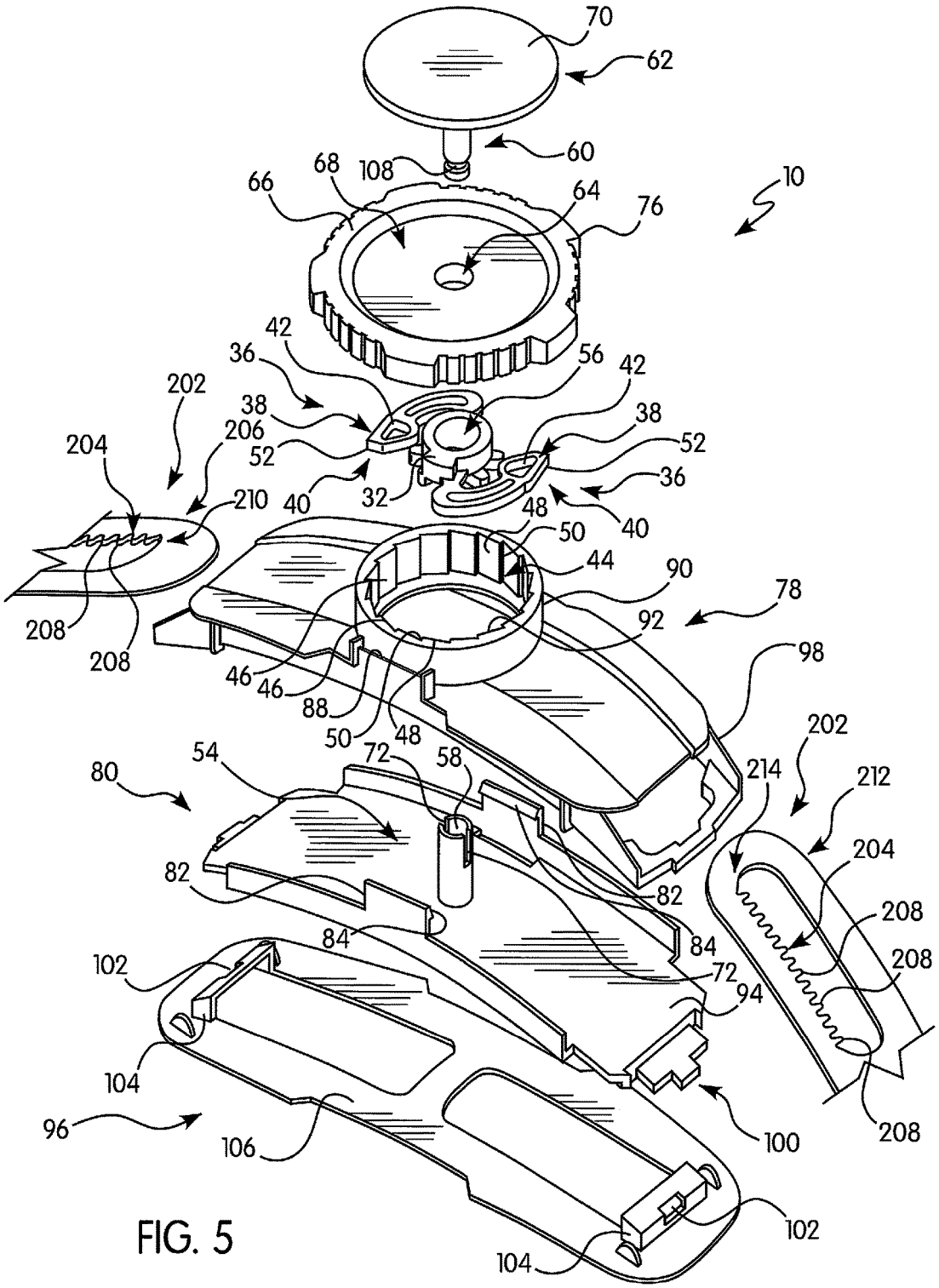
FIG. 5 is an exploded perspective view of the adjustment mechanism of FIG. 2.
Figure 6:
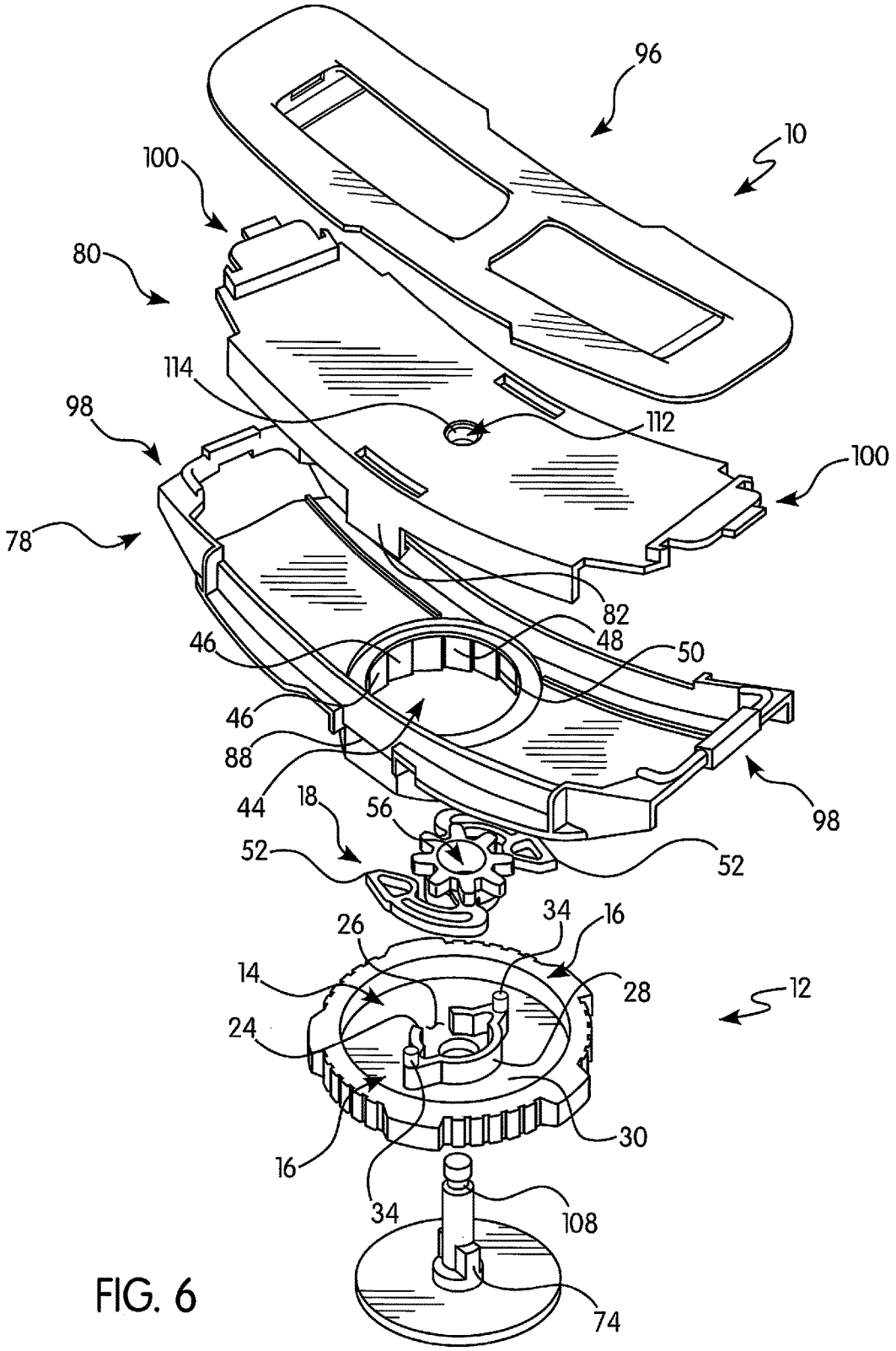
FIG. 6 is a further exploded perspective view of the adjustment mechanism of FIG. 2.

Specifically, and in one preferred and non-limiting embodiment as shown in FIGS. 2, 5, and 6, the headband member 202 includes a first end 206 with the notched track 204 positioned thereon, where the notched track 204 includes teeth 208 extending along a first edge 210. Further, the headband member 202 includes a second end 212 that also includes a notched track 204 with teeth 208 positioned thereon. As shown in FIG. 5, the notched track 204 of the second end 212 of the headband member 202 includes the teeth 208 at a second edge 214 opposite the first edge 210. As discussed hereinafter, the first end 206 and second end 212 of the headband member 202 are overlapped and positioned on or within a portion of the adjustment mechanism 10, such that the hub member 18 can simultaneously engage both notched tracks 204 of the first end 206 and second end 212. Accordingly, based upon the overlapping relationship of the first end 206 and the second end 212, together with the opposing teeth 208 on the first edge 210 and second edge 214, rotation of the hub member 18 in a first direction causes the headband member 202 to tighten about the user's head, and rotation of the hub member 18 in the second direction causes the headband member 202 to loosen with respect to the user's head. This occurs upon the engagement between the hub member 18 and both of the tracks 204, and the positioning of the opposing teeth 208 on the overlapped ends 206, 212.

In this preferred and non-limiting embodiment, and in order to rotate the hub member 18, the knob 12 is turned. In particular, upon rotation of the knob 12 in the first direction, contact between the at least one first contact member 14 (see FIG. 6) and at least a portion of the hub member 18 causes the hub member 18 to rotate in the first direction, and upon rotation of the knob 12 in the second direction, contact between the at least one second contact member 16 and at least a portion of the hub member 18 causes the hub member 18 to rotate in the second direction. In this manner, and by using these different contact members 14, 16 that are attached to or integrated with the knob 12, the adjustment mechanism 10 allows the headband member 202 to be tightened and loosened about the user's head.

In another preferred and non-limiting embodiment, the contact between the at least one first contact member 14 and the portion of the hub member 18 is substantially constant or continuous. Similarly, in this embodiment, the contact between the at least one second contact member 16 and the portion of the hub member 18 is also substantially constant or continuous. This substantially constant or continuous contact between the contact members 14, 16 and the hub member 18 may occur or be present when moving in the first direction, when moving in the second direction, and/or when in a static position. Further, by using the first contact member 14 and second contact member 16 to contact and rotate the hub member 18 in the first and second directions, the benefit of the substantially constant or continuous contact between the contact members 14, 16 and the hub member 18 provides instantaneous tactile feedback to the user when operating the adjustment mechanism 10. In particular, such substantially constant or continuous contact ensures that the tightening and loosening of the headband member 202 occurs instantly in each direction. In addition, as discussed hereinafter, and in another preferred and non-limiting embodiment, the substantially constant or continuous contact between the first contact member 14 and the hub member 18 and/or the second contact member 16 and the hub member 18 allows for substantially infinite adjustment of the hub member 18, and, thus, the headband member 202 (through engagement with the notched tracks 204).

Figure 7:
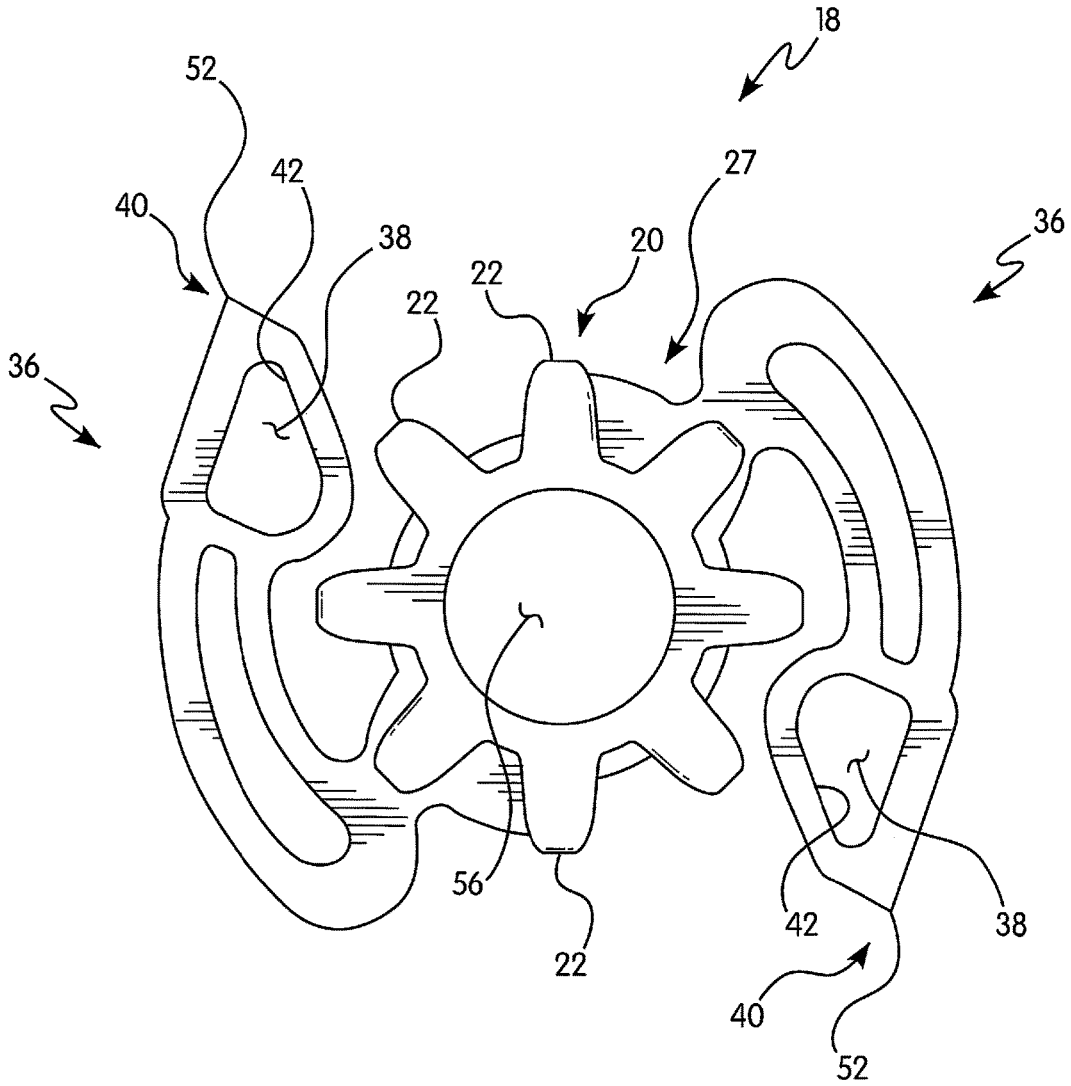
FIG. 7 is a bottom view of a hub member of the adjustment mechanism of FIG. 2.
Figure 8:
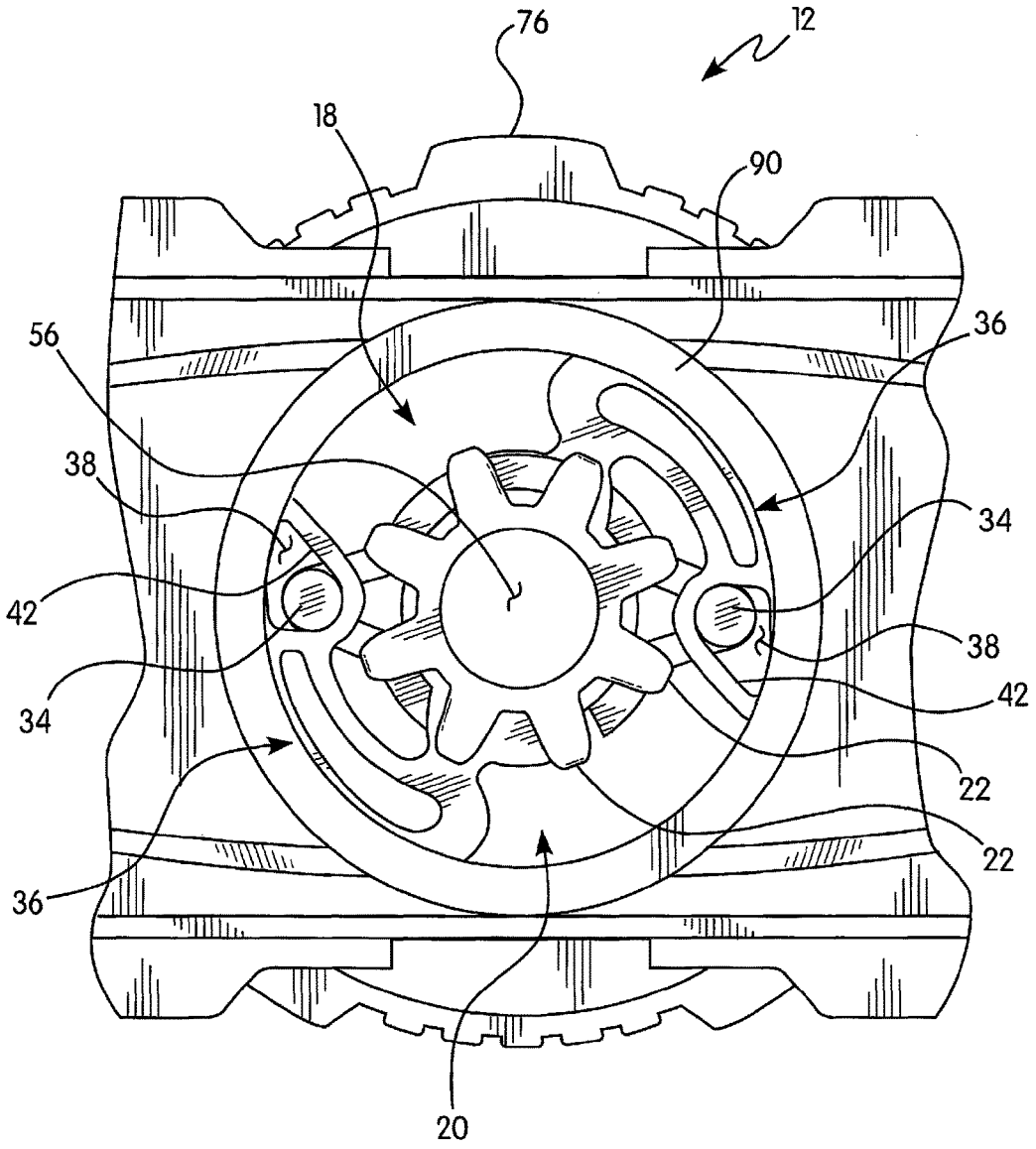
FIG. 8 is a bottom sectional view of a portion of the adjustment mechanism of FIG. 2.
Figure 9:
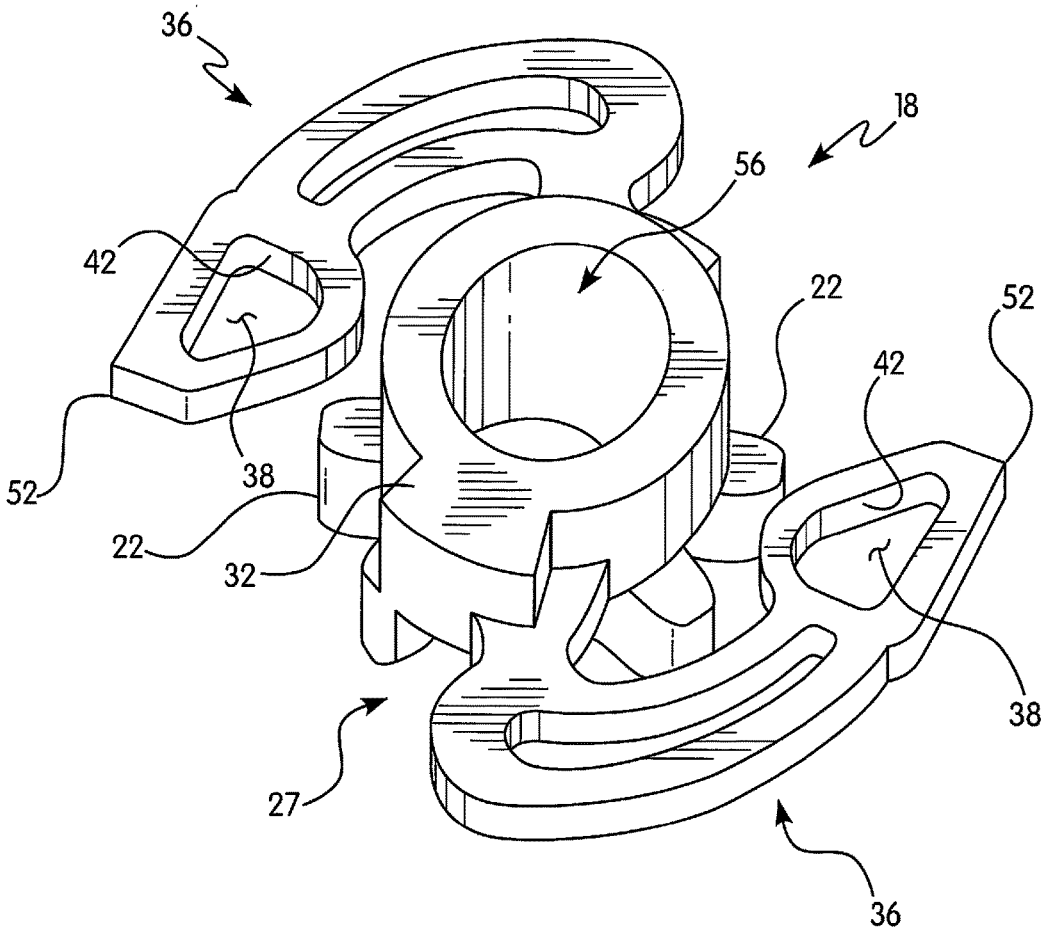
FIG. 9 is a top view of the hub member of FIG. 7.
Figure 10:
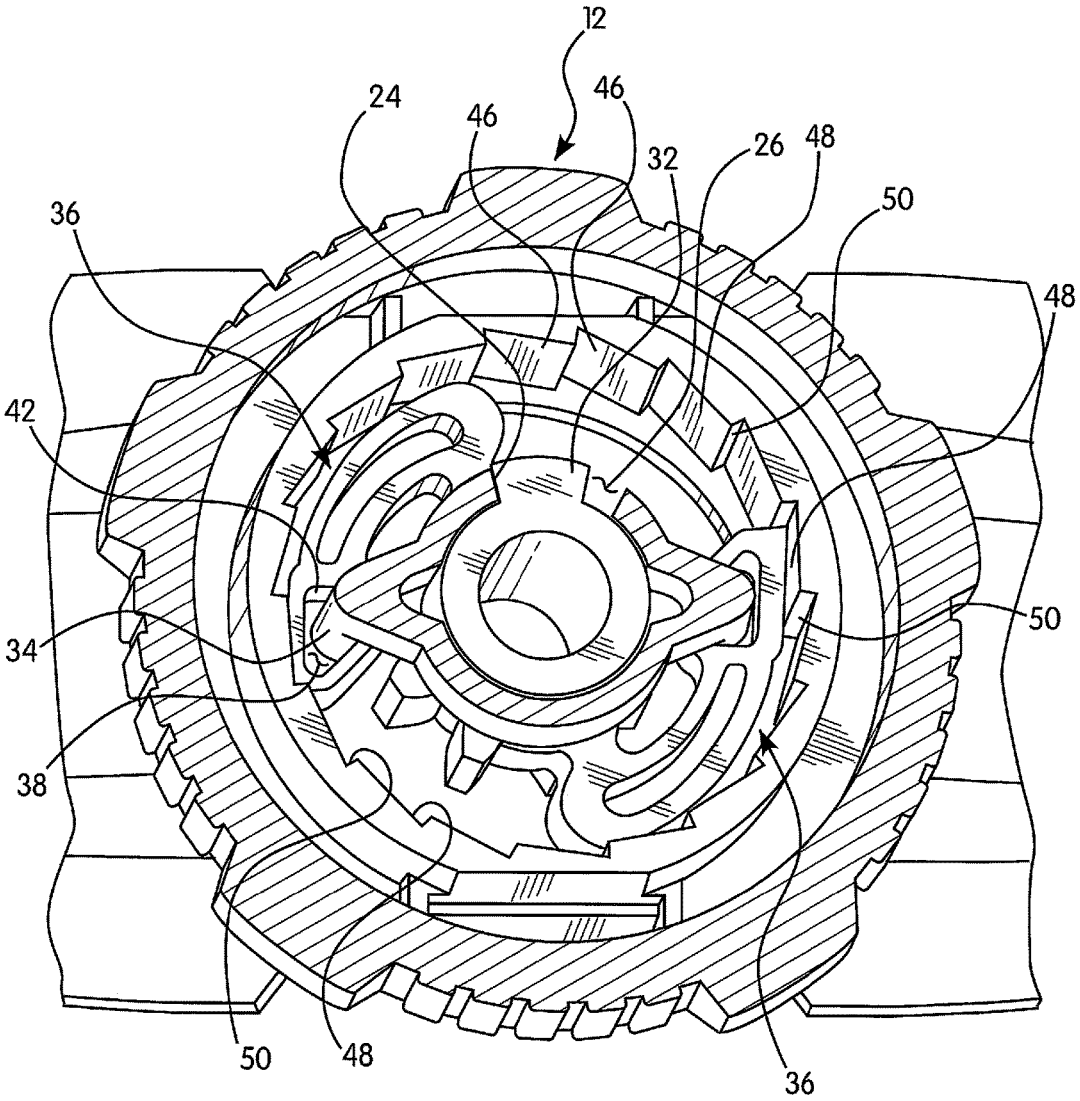
FIG. 10 is a top sectional view of a portion of the adjustment mechanism of FIG. 2.

In the preferred and non-limiting embodiment of the adjustment mechanism 10 of FIGS. 2-10, and with specific reference to FIGS. 6, 9, and 10, the at least one first contact member 14 is in the form of a surface 24 of at least one notch 26 on the knob 12, which is rotatable upon rotation of the knob 12. In particular, and in this embodiment, the notch 26 is defined by a rim 28 that extends from a bottom surface 30 of the rotatable knob 12. The surface 24 of the notch 26 is sized, shaped, or configured to contact a key 32 positioned on or integral with the hub member body 27 of the hub member 18 (see FIG. 9). When connected, and as best seen in FIG. 10, upon rotation of the knob 12 in the first direction (i.e., to tighten the headband member 202), the surface 24 contacts or otherwise engages the key 32, thereby rotating the hub member 18 in this first direction.

With reference to FIGS. 6, 7, and 8, and in another preferred and non-limiting embodiment, the at least one second contact member 16 is in the form of at least one pin 34 that projects from the bottom surface 30 of the knob 12, such that the pin 34 rotates when the knob 12 is rotated. Further, this pin 34 is sized, shaped, or configured to contact a portion of at least one spring arm 36 extending from the hub member body 27 of the hub member 18. Also, as can be seen in this preferred and non-limiting embodiment, the adjustment mechanism 10 includes two pins 34 extending from the bottom surface 30 of the rotatable knob 12, and each pin is configured to contact or engage with a respective spring arm 36 of the hub member 18.

With reference to FIGS. 3-8, and in another preferred and non-limiting embodiment, the pin 34 is at least partially received in a keyhole 38 that is positioned at or near an end 40 of the spring arm 36. In particular, and in one preferred and non-limiting embodiment, the contact between the pin 34 and a surface 42 of the keyhole 38 is substantially constant or continuous. Further, and in this embodiment, the spring arm 36 is in the form of a substantially flexible or bendable material, such that the spring arm 36 is configured to flex during movement in the second direction. As discussed hereinafter, this flexing facilitates a fine adjustment of the headband member 202 when turning the knob 12 in the second direction.

In a further preferred and non-limiting embodiment and as best illustrated in FIGS. 2, 5, and 10, at least a portion of the hub member 18 is sized, shaped, or configured to engage a notched track 44 when turned in the first direction, and urged out of engagement with the notched track 44 when turned in the second direction. Specifically, the notched track 44 includes teeth 46, and each tooth 46 includes a sloped portion 48 and a contact portion 50. As seen in FIG. 10, when the knob 12 is turned in the first direction (thus rotating the hub member 18 (and spring arms 36) in the first direction), a tip 52 of the spring arm 36 rides up the sloped portion 48 of the tooth 46 and engages with the contact portion 50 of the tooth 46. This motion is effected by or through the flexible or bendable nature of the spring arm 36. Further, this motion in the first direction provides audible and tactile feedback as the user rotates the knob 12 (based upon the movement of the tip 52 of the spring arm 36 up the sloped portion 48 and engagement or contact with the contact portion 50 when the spring arm 36 is constantly and substantially urged outward due to its flexing or bending characteristics).

As discussed above, when the knob 12 is rotated in the second direction, the pin 34 urges the spring arm 36 inward (based upon the contact between the pin 34 and the surface 42 of the keyhole 38), thereby moving the spring arm 36 out of engagement with the notched track 44. In particular, and as the user rotates the knob 12 in the second direction, and since the spring arm 36 bends inward and out of engagement with the notched track 44, the user can incrementally and continuously adjust the headband member 202 to a desired tightness (or looseness). Therefore, in this manner, the components of the adjustment mechanism 10 do not become worn or "stripped" during the tightening or loosening motions. Instead, the first contact member 14 and second contact member 16 provide an effective and robust tightening and loosening operation.

With reference to FIGS. 2, 5, and 9, and in another preferred and non-limiting embodiment, the adjustment mechanism 10 includes a central post 54, and the hub member 18 includes a central bore 56. When assembled, the central post 54 extends through the central bore 56 of the hub member 18, such that the hub member 18 is rotatable around this central post 54 in both the first and second directions. In addition, the central post 54 includes a central bore 58 into which a stem 60 is at least partially inserted. In particular, the stem 60 extends from a cap 62 and extends through a central hole 64 in the rotatable knob 12. Further, the upper surface 66 of the rotatable knob 12 includes a recessed area 68 in which the cap 62 is positioned. In one preferred and non-limiting embodiment, the cap 62 and the knob 12 are both substantially circular, as is the recessed area 68. In assembly, the stem 60 of the cap 62 is inserted through the central hole 64 of the knob 12 and into the central bore 58 of the central post 54. Based upon its positioning in the recessed area 68, the cap 62 does not project out of the recessed area 68, thereby providing an overall substantially flush upper surface of the rotatable knob 12. Still further, indicia or other information and data may be positioned, placed, or integral with an upper surface 70 of the cap 62. This allows the adjustment mechanism 10, such as the manufacture of the adjustment mechanism 10 or safety helmet, to be easily identified.

Figure 3:
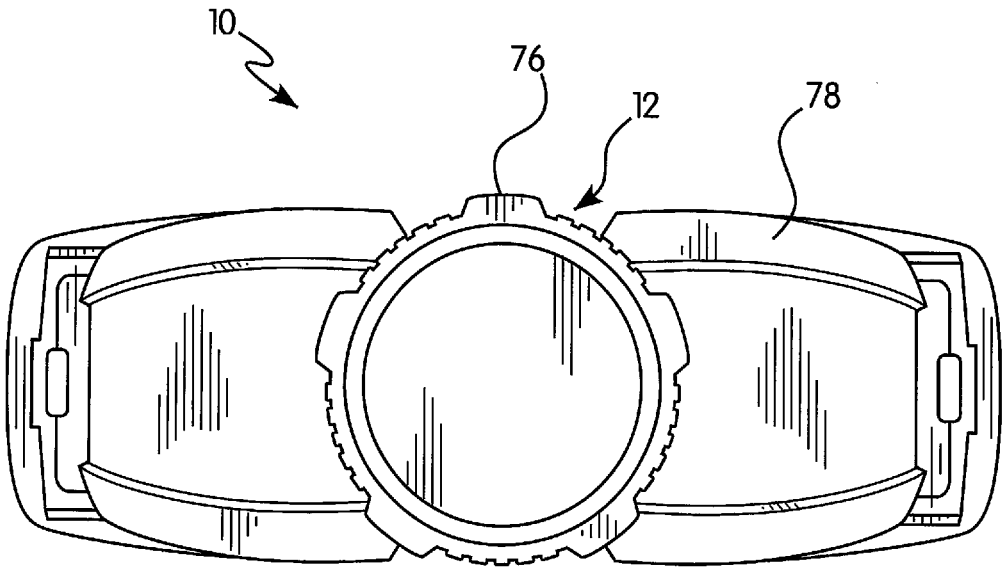
FIG. 3 is a top view of the adjustment mechanism of FIG. 2.
Figure 4:
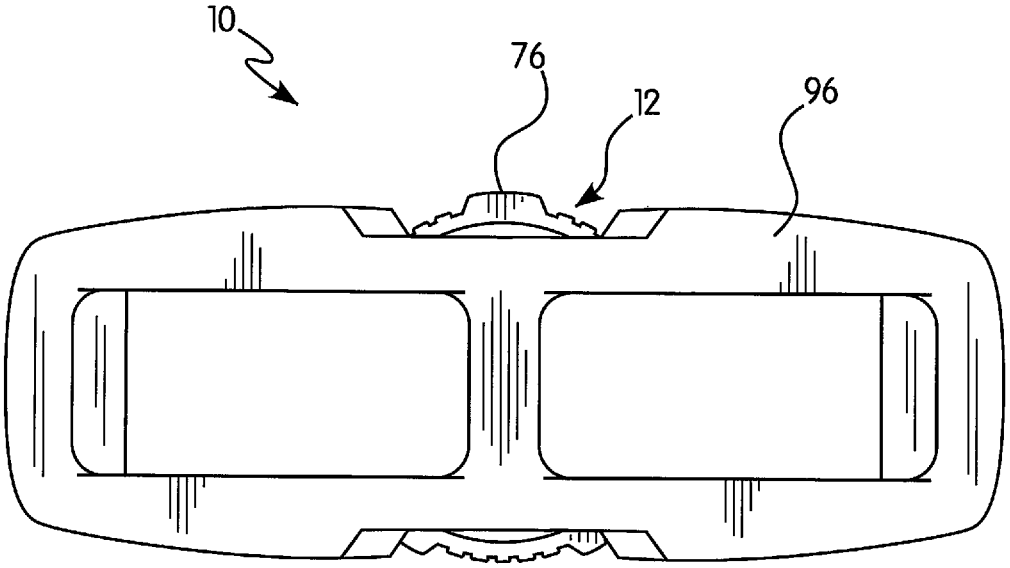
FIG. 4 is a bottom view of the adjustment mechanism of FIG. 2.

With continued reference to FIGS. 5 and 6; and in another preferred and non-limiting embodiment, the central post 54 includes at least one, and preferably two notches 72 and the stem 60 includes at least one, and preferably two corresponding projections 74. In assembly, the projections 74 of the stem 60 are positioned at least partially within a corresponding notch 72 of the central post 54. This arrangement ensures that when the knob 12, and correspondingly the hub member 18 are rotated, the cap 62 does not rotate, instead maintaining its position. In this manner, and since the cap 62 does not rotate with the knob 12, any indicia or other markings on the upper surface 70 of the cap 62 do not rotate and remain properly oriented and visually acceptable. Still further, as shown in FIGS. 3 and 4, and in another preferred and non-limiting embodiment, the rotatable knob 12 includes a gripping surface 76 (whether in the form of projections, ridges, friction surfaces, and the like) to allow the user to easily grasp and turn the knob 12 to tighten and loosen the headband member 202.

In a still further preferred and non-limiting embodiment, and as illustrated in FIGS. 2-6, the adjustment mechanism 10 includes a first ratchet housing 78 that is connectable or engageable with a second ratchet housing 80. This engagement may be permanent or, preferably, a "snap fit" connection. For example, in this preferred and non-limiting embodiment, the second ratchet housing 80 includes at least one, and preferably two tabs 82, each having a lip 84 extending from an end thereof. These tabs 82 are configured to engage with at least one, and preferably two corresponding notches 86 each including a ridge 88. In order to connect the first ratchet housing 78 and second ratchet housing 80, the tabs 82 are urged up through the notches 86, such that each lip 84 of each tab 82 moves over with and engages a respective ridge 88 of the notch 86. In order to disassemble the first ratchet housing 78 and the second ratchet housing 80, the user urges the tabs 82 away from the first ratchet housing 78, such that the lips 84 disengage with the ridges 88, thereby allowing the tabs (and second ratchet housing 80) to be removed from the notches 86 of the first ratchet housing 78.

In a further preferred and non-limiting embodiment, the first ratchet housing 78 includes a projecting track rim 90 with an inner surface 92. It is on this inner surface 92 that the above-discussed notched track 44 is positioned or otherwise formed or disposed upon. Similarly, in this preferred and non-limiting embodiment, the above-discussed central post 54 extends from the upper surface 94 of the second ratchet housing 80. In addition, and as best seen in FIGS. 5 and 6, both the first ratchet housing 78 and the second ratchet housing 80 are curved and shaped, such that the adjustment mechanism 10 has a substantially curved shape to match the round (or oval) general shape of the headband member 202 (i.e., the general shape of the user's head). This curved shape of the adjustment mechanism 10 has both aesthetic and functional qualities in that the projection of any of the components of the adjustment mechanism 10 are minimized or avoided, which may otherwise occur with a flat or linear shape.

With continued reference to FIGS. 2, 5, and 6, and in another preferred and non-limiting embodiment, the adjustment mechanism 10 includes a flexible member 96, which is connectable or engageable with the second ratchet housing 80, where this flexible member 96 is sized, shaped, or configured to contact the user's head. In addition, another pad or other comfortable material or member can be attached to the flexible member 96 to add an additional degree of comfort to the user of the safety helmet.

In a further preferred and non-limiting embodiment, and in order to attach the first ratchet housing 78, second ratchet housing 80, and flexible member 96, each end of the first ratchet housing 78 includes a shaped extension 98 that is sized, shaped, or configured to fit over or around the ends of both the second ratchet housing 80 and the flexible member 96. In particular, the second ratchet housing 80 includes a shaped extension 100 that is sized, shaped, or configured to fit at least partially within an orifice 102 (or recess) on a tab 104 extending from upper surface 106 of the flexible member 96. When assembled, the tabs 104 on each end of the flexible member 96 are engaged with or otherwise fit over a respective shaped extension 100 of the second ratchet housing 80. Further, the shaped extension 98 of the first ratchet housing 78 fits over or around the engaged flexible member 96 and second ratchet housing 80. This arrangement provides a compact, yet releasable, engagement between the first ratchet housing 78, second ratchet housing 80, and flexible member 96. Of course, it is envisioned that other attachment arrangements and configurations can be used to connect the various components of the adjustment mechanism 10 without departing from the spirit and scope thereof.

As best seen in FIGS. 3-6, and in another preferred and non-limiting embodiment, the stem 60 of the cap 62 includes a notch 108 extending around or adjacent an end 110 of the stem 60. This notch 108 is sized, shaped, or configured to engage with and at least partially through a central orifice 112 (which is formed by the central bore 58 of the central post 54) of the second ratchet housing 80. In particular, the notch 108 of the stem 60 is sized, shaped, or configured to engage over and/or with a ridge 114 positioned on, within, or adjacent the central orifice 112. This allows the stem 60 to effectively engage the knob 12, hub member 18, first ratchet housing 78, and second ratchet housing 80 in a "snap fit" connection. In another preferred and non-limiting embodiment, the end of the stem 60 has a rounded or arrowhead shape, and/or the ridge 114 is in the form of one or more angled projecting members. Such configurations provide an effective and removably attachable arrangement, and also may serve to align and/or center the various components of the adjustment mechanism 10 during assembly. Further, and since the flexible member 96 is engaged with the second ratchet housing 80, the entire adjustment mechanism 10 is easy to assemble and disassemble. Still further, and in another preferred and non-limiting embodiment, the various components may be manufactured from a synthetic material, such as a temperature or water resistant material, or preferably, a material that does not exhibit conductive properties.

Figure 11:
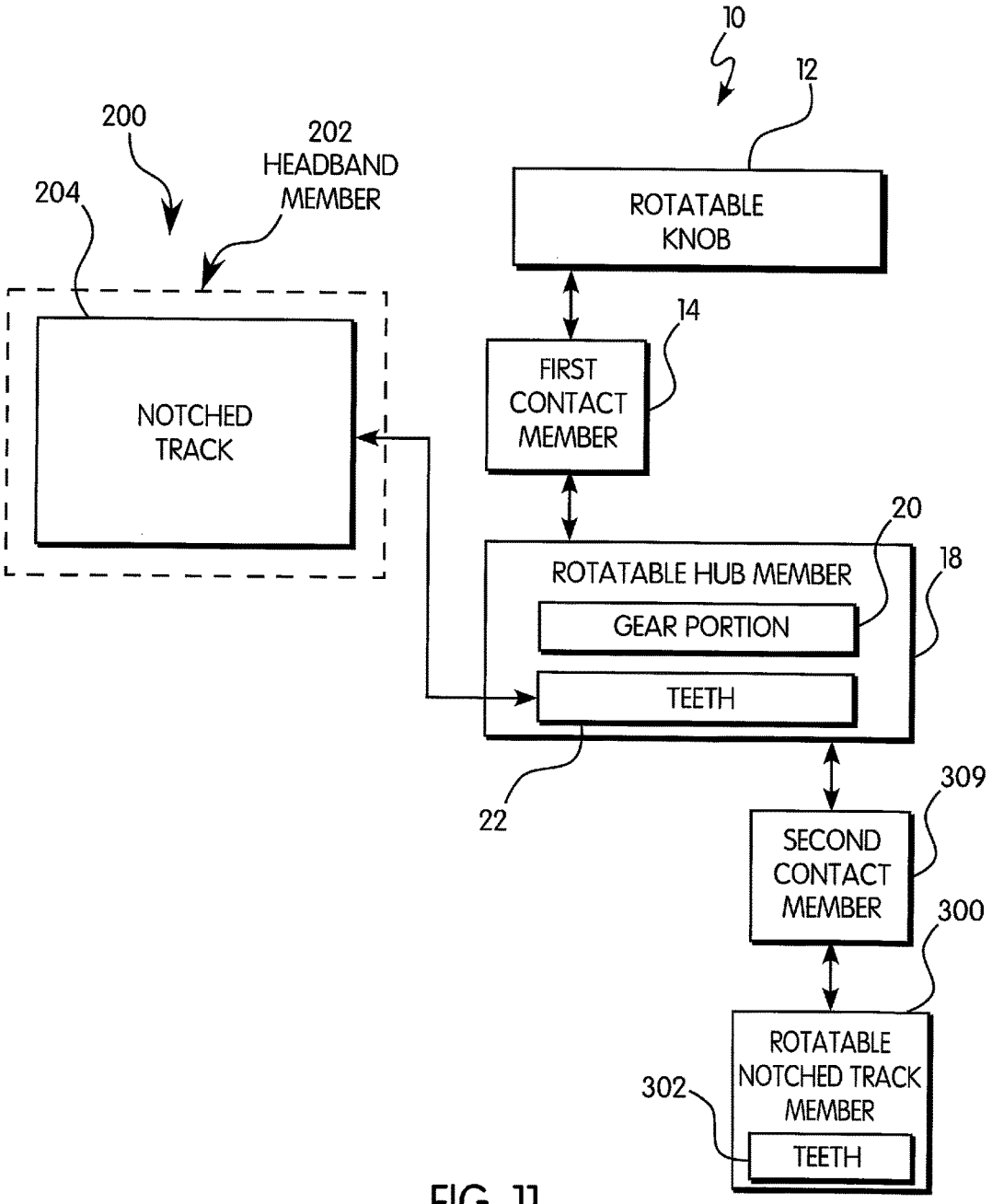
FIG. 11 is a schematic view of an adjustment mechanism for a suspension system of a safety helmet according to the principles of the present invention.
Figure 12:
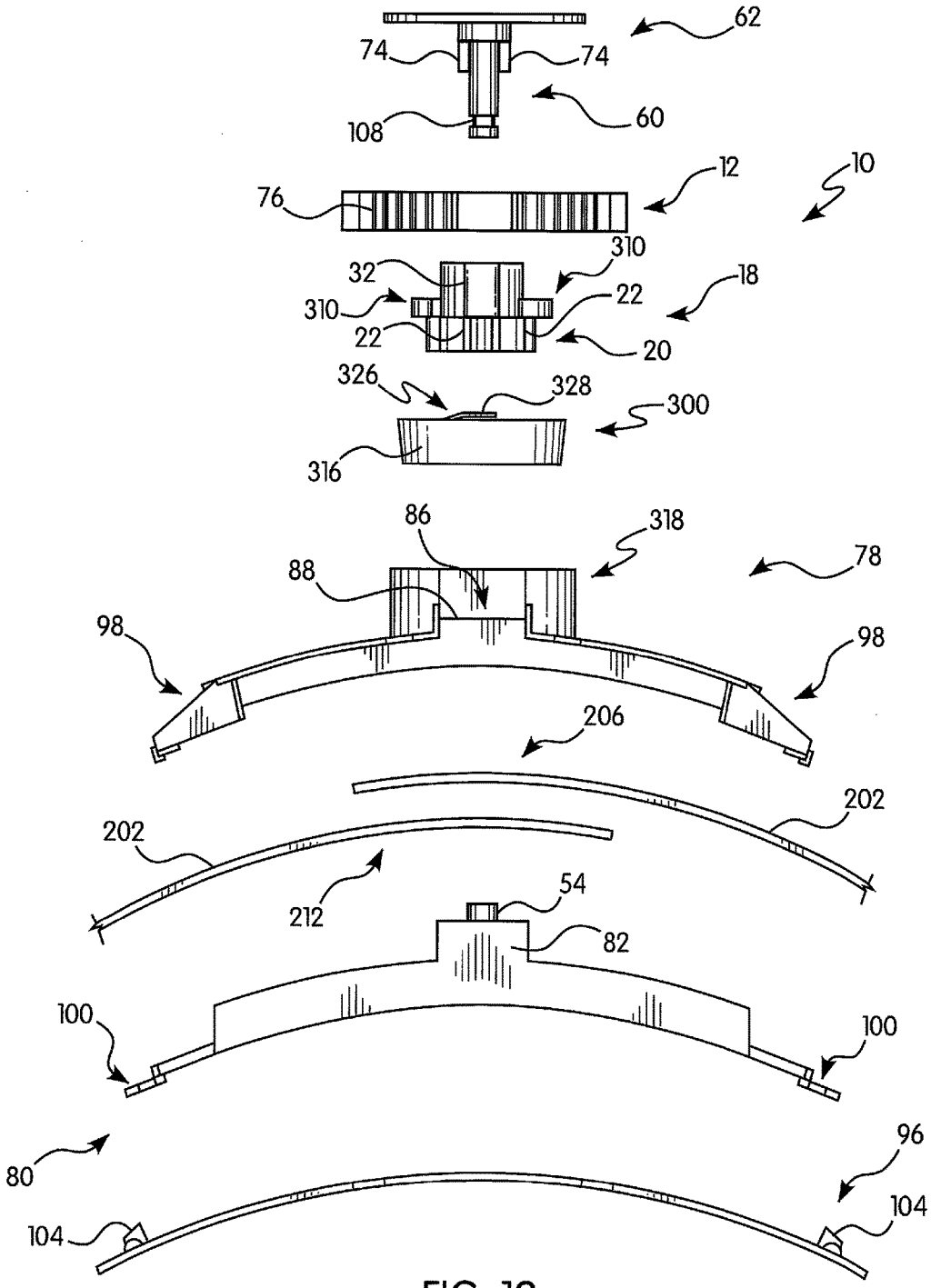
FIG. 12 is an exploded side view of one embodiment of an adjustment mechanism for a suspension system of a safety helmet according to the principles of the present invention.
Figure 13:
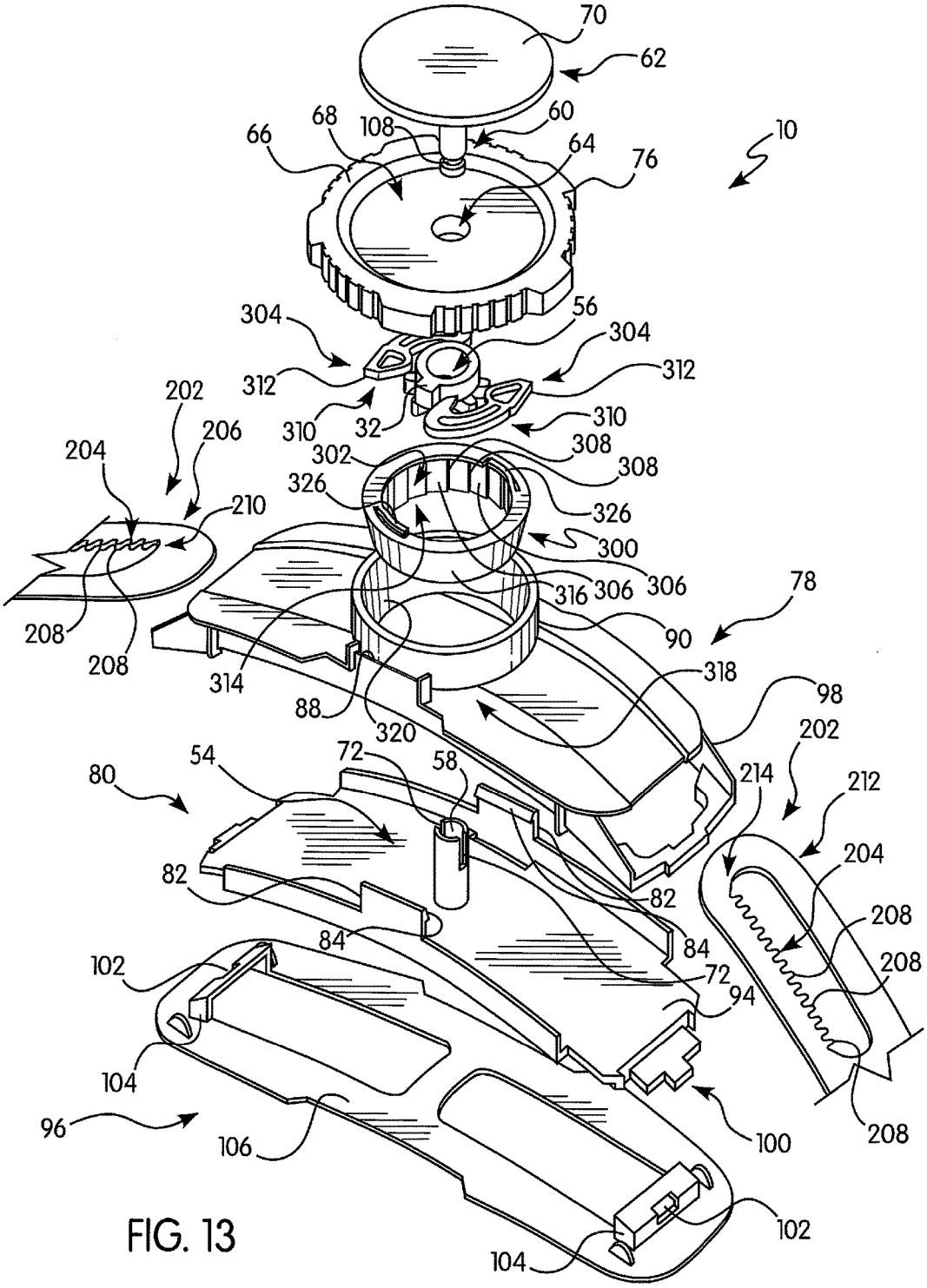
FIG. 13 is an exploded perspective view of the adjustment mechanism of FIG. 12.
Figure 14:
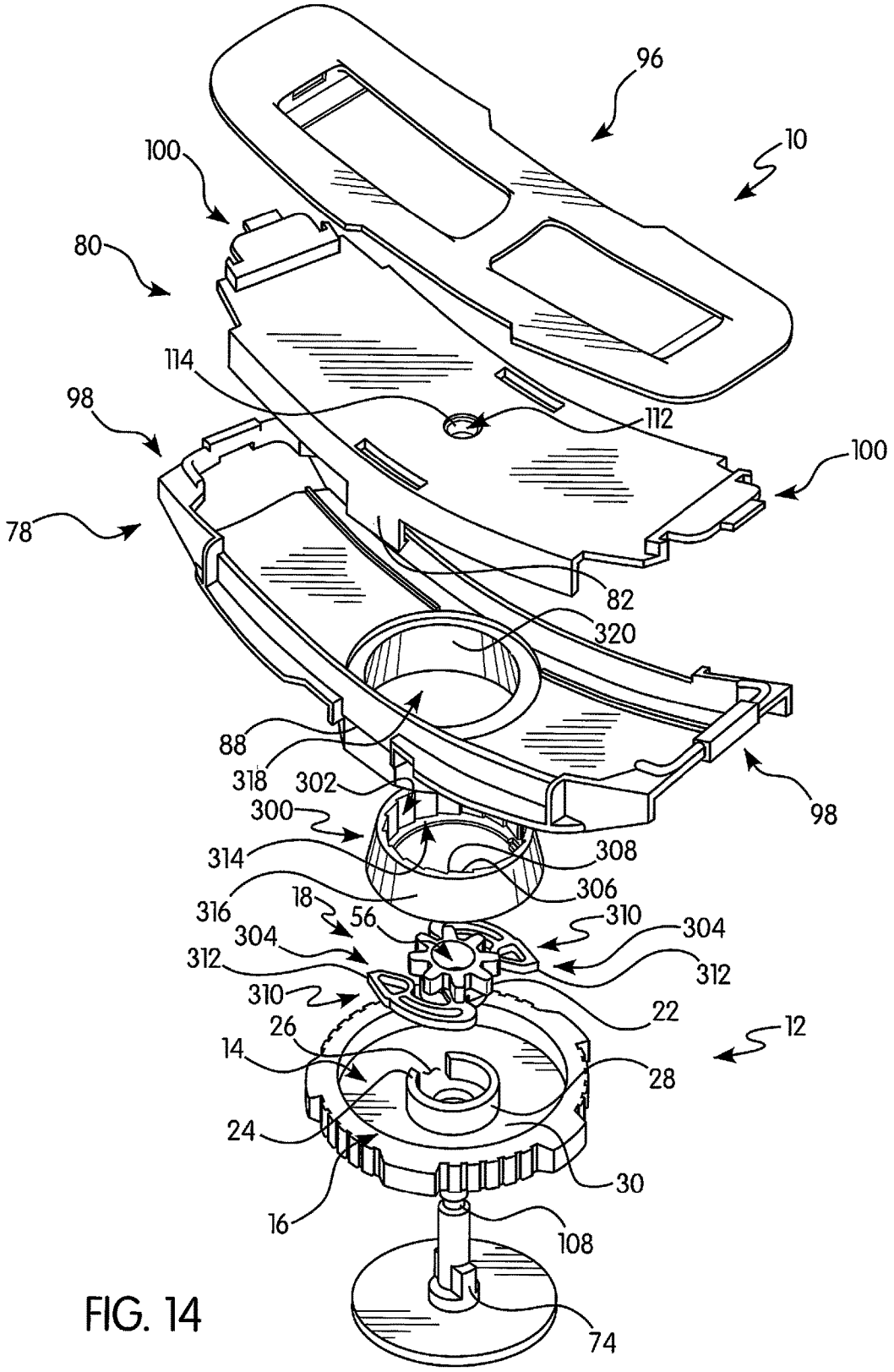
FIG. 14 is a further exploded perspective view of the adjustment mechanism of FIG. 12.
Figure 15:
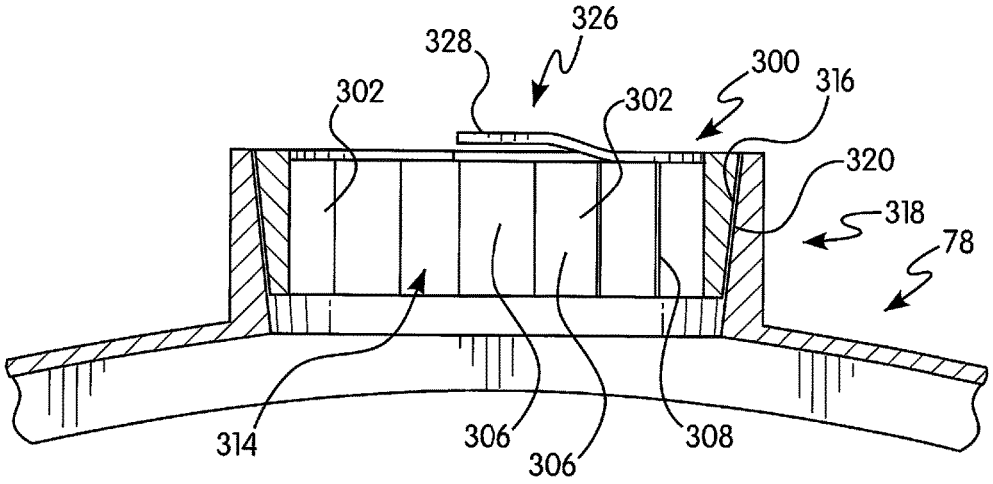
FIG. 15 is a side, sectional view of a portion of the adjustment mechanism of FIG. 12.

In a further preferred and non-limiting embodiment, and as illustrated in schematic form in FIG. 11, the adjustment mechanism 10 includes the above-discussed rotatable knob 12 including at least one first contact member 14 and a rotatable hub member 18, which includes a gear portion 20 with teeth 22 sized and shaped to engage the notched track 204 of the headband member 202. Accordingly, and as discussed, rotation of the hub member 18 in a first direction causes the headband member 202 to tighten, and rotation of the hub member 18 in a second direction causes the headband member to loosen. However, in this preferred and non-limiting embodiment, the adjustment mechanism 10 includes a rotatable notched track member 300 that includes teeth 302, which form the notched track of the rotatable notched track member 300 (see FIGS. 12-14). Upon rotation of the knob 12 in the first direction, contact between at least a portion of the at least one first contact member 14 and at least a portion of the hub member 18 causes the hub member 18 to rotate in the first direction with at least a portion of the hub member 18 interacting with the rotatable notched track member 300, such that the rotatable notched track member 300 does not rotate. Upon rotation of the knob 12 in the second direction, contact between at least a portion of at least one second contact member 304 and at least a portion of the hub member 18 causes the hub member 18 to rotate in the second direction, with at least a portion of the second contact member 304 interacting with the rotatable notched track member 300, such that the rotatable notched track member 300 rotates in the second direction.

In particular, and in this embodiment, the headband member 202 can be tightened through the interaction between the hub member 18 and the teeth 302 of the rotatable notched track member 300. In particular, certain portions of the hub member 18, which rotate as the hub member 18 rotates, engage and/or interact with the teeth 302 of the rotatable notched track member 300 in a "ratcheting" function while rotated in the first direction; while, at the same time, the teeth 22 of the hub member 18 engage and/or interact with the teeth 208 of the notched track 204 of the headband member 202 (thereby tightening the headband member 202 in a "ratcheting" manner). Accordingly, when the hub member 18 is rotated in this first direction, the rotatable notched track member 300 does not, itself, rotate. However, when the hub member 18 is rotated in the second direction, the at least one second contact member 304 engages and/or interacts with rotatable notched track member 300 and causes the rotatable notched track member 300 to rotate in the second direction (thereby loosening the headband member 202). In one preferred and non-limiting embodiment, adjustment or movement of the rotatable notched track member 300 in the second direction is substantially continual or "smooth," thereby providing substantially infinite adjustability (or loosening of the headband member 202).

In another preferred and non-limiting embodiment, and with reference to FIGS. 12-15 (and as discussed above), the at least one first contact member 14 is in the form of the surface 24 of the at least one notch 26 on the knob 12, which is rotatable upon rotation of the knob 12. As discussed, the notch 26 is defined by the rim 28 that extends from the bottom surface 30 of the rotatable knob 12, and the surface 24 of the notch 26 is sized, shaped, or configured to contact the key 32 positioned on or integral with the hub member body 27 of the hub member 18. Upon rotation of the knob 12 in the first direction (i.e., to tighten the headband member 202), the surface 24 contacts or otherwise engages the key 32, thereby rotating the hub member 18 in this first direction.

In another preferred and non-limiting embodiment, and with continued reference to FIGS. 12-15, the notched track 44 (discussed above) is replaced by the rotatable notched track member 300, such that the teeth 46 of the notched track 44 are replaced by the teeth 302, each of which include a sloped portion 306 and a contact portion 308, of the rotatable notched track member 300. In this embodiment, when the hub member 18 is rotated in the first direction, at least a portion of the hub member 18 rides up the sloped portion 306 of a tooth 302 and engages or moves in to contact with the contact portion 308 of the tooth 302. As discussed, this movement or function provides the ratcheting and tightening of the headband member 202. In another preferred and non-limiting embodiment, the hub member 18 includes at least one spring arm 310 (which may be substantially similar to or in the form of the above-discussed spring arms 36). Accordingly, in this embodiment, an end portion (or tip) 312 of the at least one spring arm 310 slides along the sloped portion 306 and in to engagement or contact with the contact portion 308. Therefore, the at least one spring arm 310 is at least partially formed from a substantially flexible or bendable material, such that the spring arm 310 can flex during movement in the first direction. In a further preferred and non-limiting embodiment, two spring arms 310 are provided and simultaneously interact with the rotatable notched track member 300.

In a further preferred and non-limiting embodiment, the at least one spring arm 310 has the additional function of acting as the at least one second contact member 304. Specifically, when the hub member 18 is rotated in the second direction (thereby rotating the at least one spring arm 310 in the second direction), the end portion 312 of the at least one spring arm 310 (which is already seated in or against the contact portion 308 of a tooth 302) urges the tooth 302, and therefore the rotatable notched track member 300, itself, in the second direction. As discussed above, this movement in the second direction causes the headband member 202 to loosen based upon the engagement between the teeth 22 of the hub member 18 and the notched track 204 of the headband member 202. In addition, and as also discussed, this movement of the rotatable notched track member 300 in the second direction is substantially continual and smooth, which maximizes the adjustability of the headband member 202.

In a further preferred and non-limiting embodiment, and with continued reference to FIGS. 12-15, the rotatable notched track member 300 includes an inner surface 314, on which the teeth 302 are disposed, and an outer surface 316. In this embodiment, this outer surface 316 is sized, shaped, or configured to slide with respect to another portion of the adjustment mechanism 10. In one preferred and non-limiting embodiment, the adjustment mechanism 10 includes the above-discussed first ratchet housing 78 with a projecting rim 318 (which is similar in form and dimension to the projecting track rim 90 discussed above) having an inner surface 320. It is against and along this inner surface 320 of the rim 318 that the outer surface 316, and therefore the rotatable notched track member 300, slides and/or rotates. Specifically, when the rotatable notched track member 300 is seated in and against the projecting rim 318, the inner surface 320 of the projecting track rim 90 and the outer surface 316 of the rotatable notched track member 300 form an interface 321 that represents a smooth sliding or bearing surface/interaction—which provides the above-discussed continual, smooth adjustability of the headband member 202 in the second direction (or loosening). In another preferred and non-limiting embodiment, the outer surface 316 of the rotatable notched track member 300 is sloped or angled, and seated against a correspondingly sloped or angled portion of the adjustment mechanism 10. In one preferred and non-limiting embodiment, this sloped or angled portion of the adjustment mechanism 10 is in the form of a sloped or angled inner surface 320 of the projecting rim 318. By including such slopes or angles, the rotatable notched track member 300 is easily positioned on and seated in the projecting rim 318.

Figure 16:
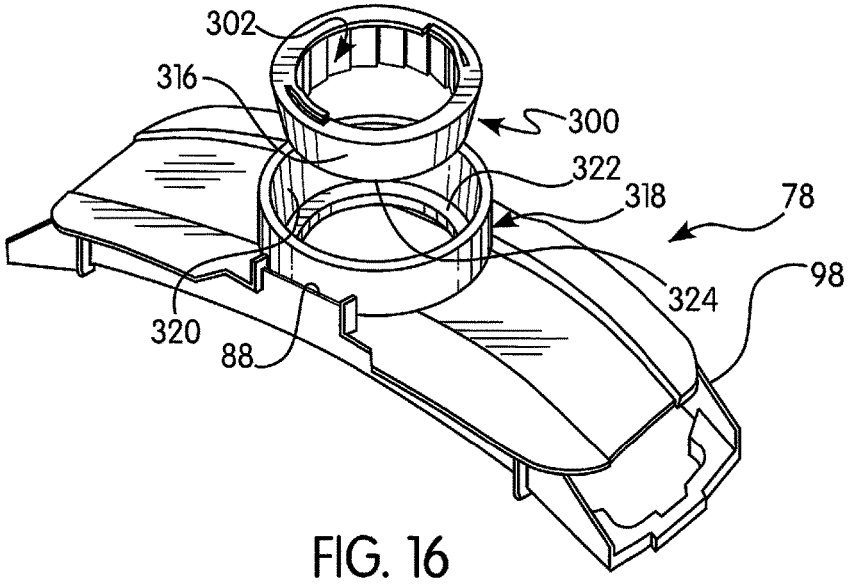
FIG. 16 is an exploded perspective view of another embodiment of a portion of an adjustment mechanism for a suspension system of a safety helmet according to the principles of the present invention.
Figure 17:
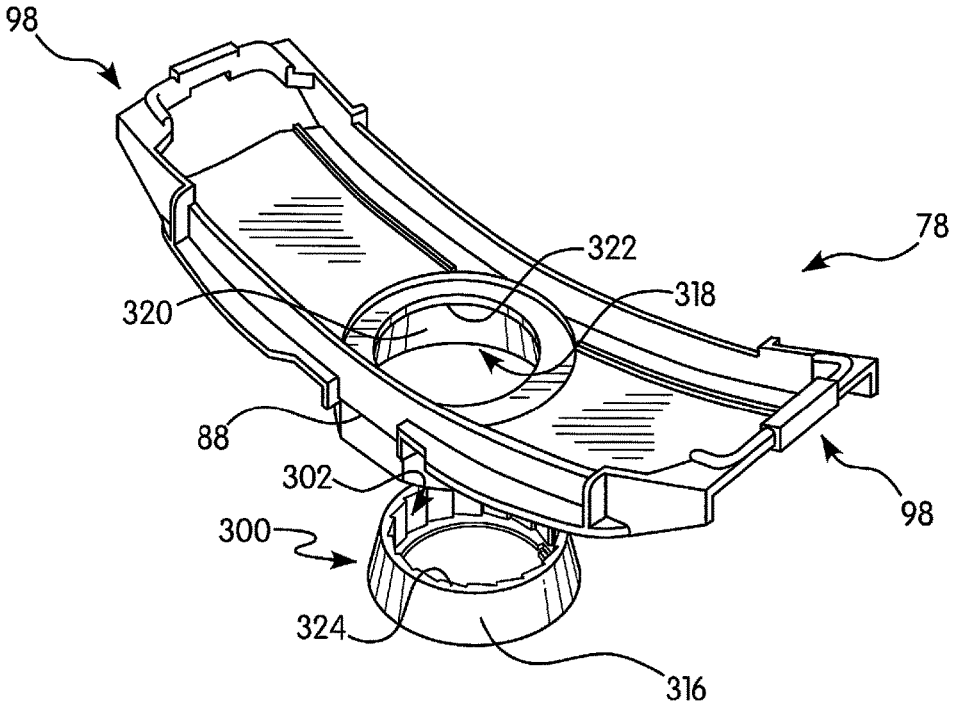
FIG. 17 is a further exploded perspective view of the portion of the adjustment mechanism of FIG. 16.
Figure 18:
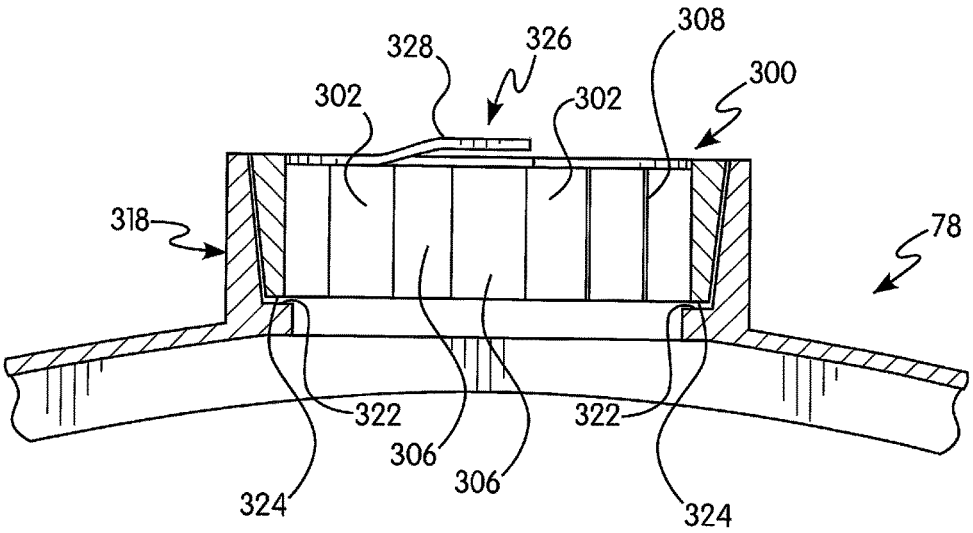
FIG. 18 is a side, sectional view of the portion of the adjustment mechanism of FIG. 16.

With reference to FIGS. 16-18, and in another preferred and non-limiting embodiment, the projecting rim 318 includes a retention rim 322, which is sized, shaped, or configured to contact or bear against at least a portion (e.g., a bottom portion 324) of the rotatable notched track member 300. In this manner, the retention rim 322 will prevent any further downward movement of the rotatable notched track member 300 after seating and during extended use. Further, by using a removable rotatable notched track member 300, and after extended use, wear-and-tear, and/or degradation of the rotatable notched track member 300, it may be simply removed from the projecting rim 318, and a new rotatable notched track member 300 positioned therein. The retention rim 322 will assist in facilitating the correct positioning and seating of the rotatable notched track member 300 in the projecting rim 318.

In a still further preferred and non-limiting embodiment, and as best seen in FIGS. 12, 13, 15, 16, and 18, at least one (and in another preferred and non-limiting embodiment, two) urging spring arm 326 is provided. This at least one urging spring arm 326 extends from the rotating notched track member 300 and includes a free end 328. The free end 328 of the at least one urging spring arm 326 is sized, shaped, or configured to contact and bear against a portion of the knob 12, such as the bottom surface 30 of the rotatable knob 12. Further, the at least one urging spring arm 326 is at least partially formed from a substantially flexible or bendable material, such that, when assembled and contacting the bottom surface 30 of the knob 12, the at least one spring arm urges the rotatable notched track member 300 into further engagement or contact with or within the projecting rim 318. It is possible that during extended or repetitious use of the adjustment mechanism 10 to tighten and loosen the headband member 202, the interface 321 between the inner surface 320 of the projecting rim 318 and the outer surface 316 of the rotatable notched track member 300 will wear, deform, or otherwise become loose (resulting in a decrease in the adjustment functionality in the second direction. Accordingly, and by using the at least one urging spring arm 326, with the resulting downward urging of the rotatable notched track member 300, this interface 321 will remain substantially constant and operable for a longer period of use.

Accordingly, provided is an adjustment mechanism 10 for use in connection with a headband arrangement 200 and headband member 202 that reduces or eliminates "slop" in the adjustment process. In addition, the presently-invented adjustment mechanism 10 prevents inadvertent loosening of the headband member 202, and provides substantially constant or continuous adjustability of the headband member 202 through the unique arrangement of the discussed components. In addition, and as discussed, the adjustment mechanism 10 is easy to assemble and disassemble, and does not require tools, or a great amount of effort to assemble and disassemble, which provides for easy maintenance of the adjustment mechanism 10. In addition, and as discussed above, in one preferred and non-limiting embodiment, some or all of the components discussed herein are made from a material that is non-conductive, e.g., non-metallic, which is preferable in many work or hazardous environments.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An adjustment mechanism for a headband arrangement having a headband member with at least one headband notched track positioned on an end thereof, the adjustment mechanism comprising:

a rotatable knob having at least one first contact member;

a rotatable hub member having at least one second contact member and a gear portion with teeth configured to contact the at least one headband notched track of the headband member, such that rotation of the hub member in a first direction causes the headband member to tighten and rotation of the hub member in a second direction causes the headband member to loosen; and a rotatable notched track member comprising a plurality of teeth, wherein the at least one second contact member of the hub member is configured to contact at least a portion of the plurality of teeth of the rotatable notched track member, wherein, upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between the at least one second contact member and at least a portion of the rotatable notched track member causes the hub member to rotate in the second direction with at least a portion of the at least one second contact member interacting with the rotatable notched track member, such that the rotatable notched track member rotates in the second direction, and wherein each of the plurality of teeth of the rotatable notched track member comprise a sloped portion and a contact portion, such that when the hub member is turned in the first direction, at least a portion of the hub member slides along the sloped portion of at least one tooth of the plurality of teeth and into contact with the contact portion of the at least one tooth of the plurality of teeth.

2. The adjustment mechanism of claim 1, wherein the at least one first contact member is a surface of at least one notch that is rotatable upon rotation of the knob and configured to contact at least one key of the hub member positioned at least partially within the notch, thereby rotating the hub member in the first direction.

3. The adjustment mechanism of claim 1, wherein the hub member comprises at least one spring arm, wherein an end portion of the at least one spring arm slides along the sloped portion of at least one of the plurality of teeth and into contact with the contact portion of the at least one of the plurality of teeth.

4. The adjustment mechanism of claim 3, wherein the at least one spring arm comprises a substantially flexible material, such that the at least one spring arm is configured to flex during movement in the first direction.

5. The adjustment mechanism of claim 1, wherein the hub member comprises at least one spring arm, and wherein the at least one second contact member comprises at least a portion of the at least one spring arm, such that when the hub member is turned in the second direction, the at least a portion of the at least one spring arm contacts the rotatable notched track member and urges the rotatable notched track member in the second direction.

6. The adjustment mechanism of claim 5, wherein when the hub member is turned in the second direction, an end portion of the at least one spring arm contacts at least a portion of the contact portion of at least one tooth of the plurality of teeth and urges the rotatable notched track member in the second direction.

7. The adjustment mechanism of claim 1, wherein the rotatable notched track member comprises an inner surface comprising the plurality of teeth, and an outer surface, wherein the outer surface is configured to contact and slide with respect to a portion of the adjustment mechanism.

8. The adjustment mechanism of claim 7, wherein the outer surface of the rotatable notched track member is sloped and seated against a corresponding sloped surface of the portion of the adjustment mechanism.

9. The adjustment mechanism of claim 7, wherein the rotatable notched track member comprises at least one urging spring arm configured to contact at least a portion of the rotatable knob, such that the rotatable notched track member is urged in a downward direction and against the portion of the adjustment mechanism.

10. The adjustment mechanism of claim 7, wherein the portion of the adjustment mechanism includes a retention rim configured to contact at least a portion of the rotatable notched track member and prevent further downward movement when the rotatable notched track member is seated in the portion of the adjustment mechanism.

11. The adjustment mechanism of claim 7, wherein the portion of the adjustment mechanism is an inner surface of a rim projecting from a first ratchet housing of the adjustment mechanism.

12. The adjustment mechanism of claim 11, wherein the first ratchet housing is engageable with a second ratchet housing.

13. The adjustment mechanism of claim 12, wherein the second ratchet housing comprises a central post, wherein the hub member includes a central bore through which the central post extends, such that the hub member is rotatable around the central post in the first and second directions.

14. The adjustment mechanism of claim 1, further comprising a central post, wherein the hub member includes a central bore through which the central post extends, such that the hub member is rotatable around the central post in the first and second directions.

15. The adjustment mechanism of claim 14, wherein the central post comprises: a central bore into which a stem is at least partially inserted and at least one notch, wherein the stem comprises at least one projection configured to be at least partially inserted in the at least one notch.

16. A suspension system for a safety helmet, comprising:

a headband arrangement having a headband member with at least one notched track positioned on an end thereof;

at least one strap connected to at least one tab, wherein the at least one tab is configured to be inserted at least partially into at least one headband slot positioned on an internal surface of the safety helmet; and an adjustment mechanism, comprising:

(i) a rotatable knob having at least one first contact member;

(ii) a rotatable hub member having at least one second contact member and a gear portion with teeth configured to contact the at least one headband notched track of the headband member, such that rotation of the hub member in a first direction causes the headband member to tighten and rotation of the hub member in a second direction causes the headband member to loosen; and (iii) a rotatable notched track member comprising a plurality of teeth, wherein the at least one second contact member of the hub member is configured to contact at least a portion of the plurality of teeth of the rotatable notched track member, wherein, upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between the at least one second contact member and at least a portion of the rotatable notched track member causes the hub member to rotate in the second direction with at least a portion of the at least one second contact member interacting with the rotatable notched track member, such that the rotatable notched track member rotates in the second direction, and wherein each of the plurality of teeth of the rotatable notched track member comprise a sloped portion and a contact portion, such that when the hub member is turned in the first direction, at least a portion of the hub member slides along the sloped portion of at least one tooth of the plurality of teeth and into contact with the contact portion of the at least one tooth of the plurality of teeth.

17. A safety helmet, comprising:

a protective helmet body having an internal surface with at least one headband slot positioned thereon;

a suspension system for a safety helmet, comprising:

a headband arrangement having a headband member with at least one notched track positioned on an end thereof;

at least one strap connected to at least one tab, wherein the at least one tab is configured to be inserted at least partially into the at least one headband slot to thereby connect the suspension system and the helmet body; and an adjustment mechanism, comprising:

(i) a rotatable knob having at least one first contact member;

(ii) a rotatable hub member having at least one second contact member and a gear portion with teeth configured to contact the at least one headband notched track of the headband member, such that rotation of the hub member in a first direction causes the headband member to tighten and rotation of the hub member in a second direction causes the headband member to loosen; and (iii) a rotatable notched track member comprising a plurality of teeth, wherein the at least one second contact member of the hub member is configured to contact at least a portion of the plurality of teeth of the rotatable notched track member, wherein, upon rotation of the knob in the first direction, contact between the at least one first contact member and at least a portion of the hub member causes the hub member to rotate in the first direction with at least a portion of the hub member interacting with the rotatable notched track member, such that the rotatable notched track member does not rotate, and upon rotation of the knob in the second direction, contact between the at least one second contact member and at least a portion of the rotatable notched track member causes the hub member to rotate in the second direction with at least a portion of the at least one second contact member interacting with the rotatable notched track member, such that the rotatable notched track member rotates in the second direction, and wherein each of the plurality of teeth of the rotatable notched track member comprise a sloped portion and a contact portion, such that when the hub member is turned in the first direction, at least a portion of the hub member slides along the sloped portion of at least one tooth of the plurality of teeth and into contact with the contact portion of the at least one tooth of the plurality of teeth.

* * * * *